US010890399B2

(12) United States Patent
Gardner, Jr. et al.

(10) Patent No.: US 10,890,399 B2
(45) Date of Patent: Jan. 12, 2021

(54) BARREL WITH RIFLING AND METHOD FOR FORMING

(71) Applicant: GOG Paintball, S.A., Plaza Roble Escazu (BR)

(72) Inventors: William M. Gardner, Jr., Loyalhanna, PA (US); Hans Semelsberger, Loyalhanna, PA (US)

(73) Assignee: GOG Paintball, S.A., San José (CR)

( * ) Notice: Subject to any disclaimer, the term of this patent is extended or adjusted under 35 U.S.C. 154(b) by 0 days.

(21) Appl. No.: 16/448,505

(22) Filed: Jun. 21, 2019

(65) Prior Publication Data

US 2020/0003514 A1 Jan. 2, 2020

Related U.S. Application Data

(60) Provisional application No. 62/692,997, filed on Jul. 2, 2018.

(51) Int. Cl.
*F41A 21/18* (2006.01)

(52) U.S. Cl.
CPC ..... *F41A 21/18* (2013.01)

(58) Field of Classification Search
CPC ..... F41A 21/18; F41A 21/16
See application file for complete search history.

(56) References Cited

U.S. PATENT DOCUMENTS 2,850,828 A * 9/1958 Sullivan ..... F41A 21/04 42/76.02
3,673,916 A * 7/1972 Wittholz ..... F41A 21/18 89/1.816
4,646,618 A * 3/1987 Kurth ..... B29C 67/0014 89/1.816
4,729,806 A * 3/1988 Stein ..... B29C 63/0021 156/172

(Continued)

FOREIGN PATENT DOCUMENTS

GB 135072 A * 11/1919 ..... F41A 21/487

OTHER PUBLICATIONS

Lilja, "Calibers and Twist Rates ", https://riflebarrels.com/calibers-and-twist-rates/ (Year: 2016).*

(Continued)

*Primary Examiner* — Joshua T Semick
(74) *Attorney, Agent, or Firm* — Craig R Rogers; Simple IP Law, PC

(57) ABSTRACT

A rifled barrel may have a rifling pattern formed along an internal surface of the barrel by forming a corresponding pattern on the external surface of the barrel. The rifling pattern includes one or more indentations or protrusions formed in a spiral pattern along a length of the barrel. The corresponding pattern includes indentations formed into the external surface. A method of manufacturing includes moving a length of tubing past a die or other tool having one or more protrusions configured to indent the external surface. Alternatively, the rifled pattern may be formed by drawing (Continued)

a tool through tubing before it is cut into individual barrel lengths. The tool or tubing is rotated to create one or more spiral indentations and/or protrusions in a rifling pattern along the internal diameter of the tubing. The tubing is then cut and provided with threading to form a rifled barrel.

20 Claims, 8 Drawing Sheets

(56) References Cited

U.S. PATENT DOCUMENTS

| | | | | |
|---|---|---|---|---|
| 5,228,427 | A * | 7/1993 | Gardner, Jr. | F41A 21/28 124/71 |
| 5,856,631 | A * | 1/1999 | Julien | F41A 21/02 42/76.02 |
| 6,453,593 | B1 * | 9/2002 | Dillon | F41A 21/16 42/76.01 |
| 6,494,195 | B2 * | 12/2002 | Perry | F41A 21/04 124/73 |
| 7,802,393 | B2 * | 9/2010 | Judson | F41A 21/20 264/102 |
| 7,934,332 | B2 * | 5/2011 | Briggs | F41A 21/02 29/520 |
| 8,291,632 | B2 * | 10/2012 | Taylor | F41A 21/18 42/76.01 |
| 8,776,425 | B2 * | 7/2014 | Pelin | F41A 21/18 42/76.1 |
| 9,212,860 | B2 * | 12/2015 | Kunau | F41A 99/00 |
| 9,234,716 | B2 * | 1/2016 | Feddersen | F41A 21/18 |

OTHER PUBLICATIONS

LifeLine, "How a Precision Rifle Barrel Is Made: with International Barrels Inc.", https://www.youtube.com/watch?v=LAf064S2Cv4, (Year: 2017).*

NFSTC, "Module 04 :: Broached", https://projects.nfstc.org/firearms/module04/fir_m04_t06_06_a.htm, (Year: 2015).*

NFSTC, "Module 04 :: Button Swaged", http://projects.nfstc.org/firearms/module04/fir_m04_t06_06_b.htm, (Year: 2015).*

Lilja, "Pre Thread Option ", https://riflebarrels.com/pre-thread-option/, (Year: 2015).*

Lilja, "The Making of a Rifle Barrel", http://riflebarrels.com/the-making-of-a-rifle-barrel/ (Year: 2016).*

Vortakt, "Barrel Blank Specifications" (Year: 2017).*

* cited by examiner

EXTRUSION PROFILE
MATCHED ON OUTSIDE

SECTION A-A

BARREL WITH RIFLING AND METHOD FOR FORMING

PRIORITY CLAIM

Claim for Priority

This application is a non-provisional of, and claims priority from, U.S. Provisional Patent App. Ser. No. 62/692,997, filed Jul. 2, 2018, the contents of which are incorporated herein by reference, in their entirety.

BACKGROUND OF THE INVENTION

Field of the Invention

This invention relates generally to barrels for paintball and other pneumatic guns, as well as to barrels for firearms. More particularly, this invention relates to a barrel having rifling formed therein and the method of forming the same.

Related Art

Pneumatic guns such as paintball guns, airsoft guns, bb guns, pellet guns, and the like, use barrels to direct the projectile from the gun toward the target. Spin may be imparted to the projectiles through air ports or rifling formed in the barrel. Firearms also typically have rifled gun barrels. Unfortunately, conventional rifling for a gun barrel may be difficult or expensive to produce. For instance, rifling is typically cut or formed into the barrel tube as a secondary process once the barrel has been extruded, cut and formed. In this process, each barrel must be individually rifled as a separate and individual part, increasing the production difficulty and costs.

Furthermore, because of limitations on the internal diameter (ID) tooling used in the conventional drawing process for forming rifling, there are limits to the caliber of the barrel than can be produced having rifling using conventional processes. Specifically, traditional processes are generally unable to form a rifled barrel having very small calibers. An improved method of providing rifling to a barrel for a pneumatic gun and a resulting improved pneumatic gun barrel are therefore desired. Firearm barrels may also benefit from principles of the present inventive concepts.

SUMMARY OF THE INVENTION

According to various embodiments and principles of the present invention, a barrel for a pneumatic gun or firearm can provide numerous improvements over the prior art. More particularly, the principles of the present inventive concepts enable a barrel having rifling formed from an exterior of the barrel during an extrusion and/or drawing process and a method of forming the same. More particularly, a rifling pattern can be provided by rifling ridges formed on an inside diameter of the barrel during an extrusion and/or drawing process. The rifling ridges may be formed, for instance, on the inside of the barrel by impressing corresponding features into an external diameter of a tube (or tubing) during an extrusion or drawing process. This process is mainly suitable for aluminum (or similar material) barrels that can be readily formed through an extrusion process.

By impressing the rifling patterns into the tubing through its external diameter during the extrusion process, the rifling pattern manufacturing process can be simplified significantly and further reduce production costs. By patterning the rifling into the tubing during the extrusion process, for instance, a full-length (i.e., many feet long; such as 20 to 40 feet or more) extrusion tube may be rifled at once, before the tubing is cut into individual barrel sections. Furthermore, by applying the rifling pattern from the exterior of the tubing, various problems and limitations of the conventional process (which applied rifling directly to the internal diameter of barrel sections) can be avoided. The process according to the present inventive concepts can be used, for instance, to form rifled barrels as small as 0.177" caliber or less. Accordingly, by imparting the rifling to the tubing from the outside during the extrusion process, production costs can be significantly reduced. And, in addition to cost savings, barrels formed using this method can also have improved size dimensions and other benefits.

According to a first embodiment, a tube is extruded through a die (or other tool) having one or more protruding ridges formed thereon. The die communicates with an external diameter of the tube such that the die ridge(s) indent the external diameter of the tube and thereby cause one or more corresponding ridges to be formed along an internal diameter of the tube. The die and/or the tube can be rotated during the extrusion process at a predetermined or variable twist rate to rotate the impressions formed on the outside diameter of the tube and the corresponding ridges formed along the interior diameter of the tube. A constant or variable speed motor could be used, for instance, to rotate the tube or die. In this manner, the pattern impressed into the outside diameter of the tube can form a desired rifling pattern on the inside diameter of the tube throughout the entire length of the tube.

This process is therefore able to form polygonal rifling without the typically required hammer forging process. Some advantages of polygonal rifling include, for instance, a better gas seal around a projectile being fired through the barrel; less deformation of the projectile and less drag; a reduced buildup of lead fouling in a firearm barrel; and barrels that are less sensitive to stress concentrations because, unlike groove cutting, there are no sharp corners.

In an alternative embodiment, the rifling pattern could be formed in long lengths of tubing through a drawing process that is entirely separate from, or accompanies, an extrusion process. Unlike the conventional method, however, by applying a drawing process to the tubing before cutting into barrel lengths, production efficiencies can be obtained.

In a drawing process, a die or tool may be pulled through the internal diameter of the tube to provide the rifling to the internal diameter. In such an embodiment, the drawing tool may have an octagonal, hexagonal, pentagonal, or other shape with a desired width or external diameter, and may be rotated as it is drawn through the internal diameter of the tubing. Alternatively, or additionally, the tubing may be rotated during the drawing process. The rotation speed of the tubing and/or tool may be selected to provide the desired twist rate of the rifling pattern. Although the drawing process may not be able to form as small a rifled barrel as the aforementioned extrusion process, it may still be used to form rifling in long sections of tubing before the tubing is cut and threaded to form individual barrels. This process may therefore still result in cost savings over traditional methods.

After either the extrusion or drawing process, the extruded or drawn tube can then be cut into barrel sections, each having a desired barrel length. Each barrel section can then be provided with a connection mechanism, such as threading, to enable the barrel to be connected to a pneumatic or other gun. The final barrel can therefore comprise a connection mechanism for connecting to a gun (such as a pneumatic gun or firearm), a rifling pattern formed on an internal diameter of the barrel, and, in some embodiments, a corresponding pattern formed on the external diameter of the barrel.

Of course, the inventive principles are not limited to the specific features and embodiments disclosed, and various additional aspects, embodiments, and configurations are possible without departing from the principles disclosed herein. For instance, as suggested, one or more of the principles of this invention could be applied to barrels for firearms and other types of guns, in addition to pneumatic guns. This invention is therefore not limited to any of the particular aspects, embodiments, or configurations described herein.

BRIEF DESCRIPTION OF DRAWINGS

The foregoing and additional objects, features, and advantages of the present inventive concepts will become more readily apparent from the following detailed description of preferred embodiments, made with reference to the accompanying drawings, in which.

DETAILED DESCRIPTION OF ILLUSTRATIVE EMBODIMENTS

Various features, benefits, and configurations incorporating the principles of the present inventive concepts will be readily apparent through the illustrative embodiments shown in the accompanying drawings. Additional features, benefits, and configurations will be readily apparent to those of ordinary skill in the art based on this disclosure, and all such features, benefits, and configurations are considered within the scope of the present invention. Illustrative embodiments will now be described in further detail in connection with the accompanying drawings.

Figures 1, 1A:
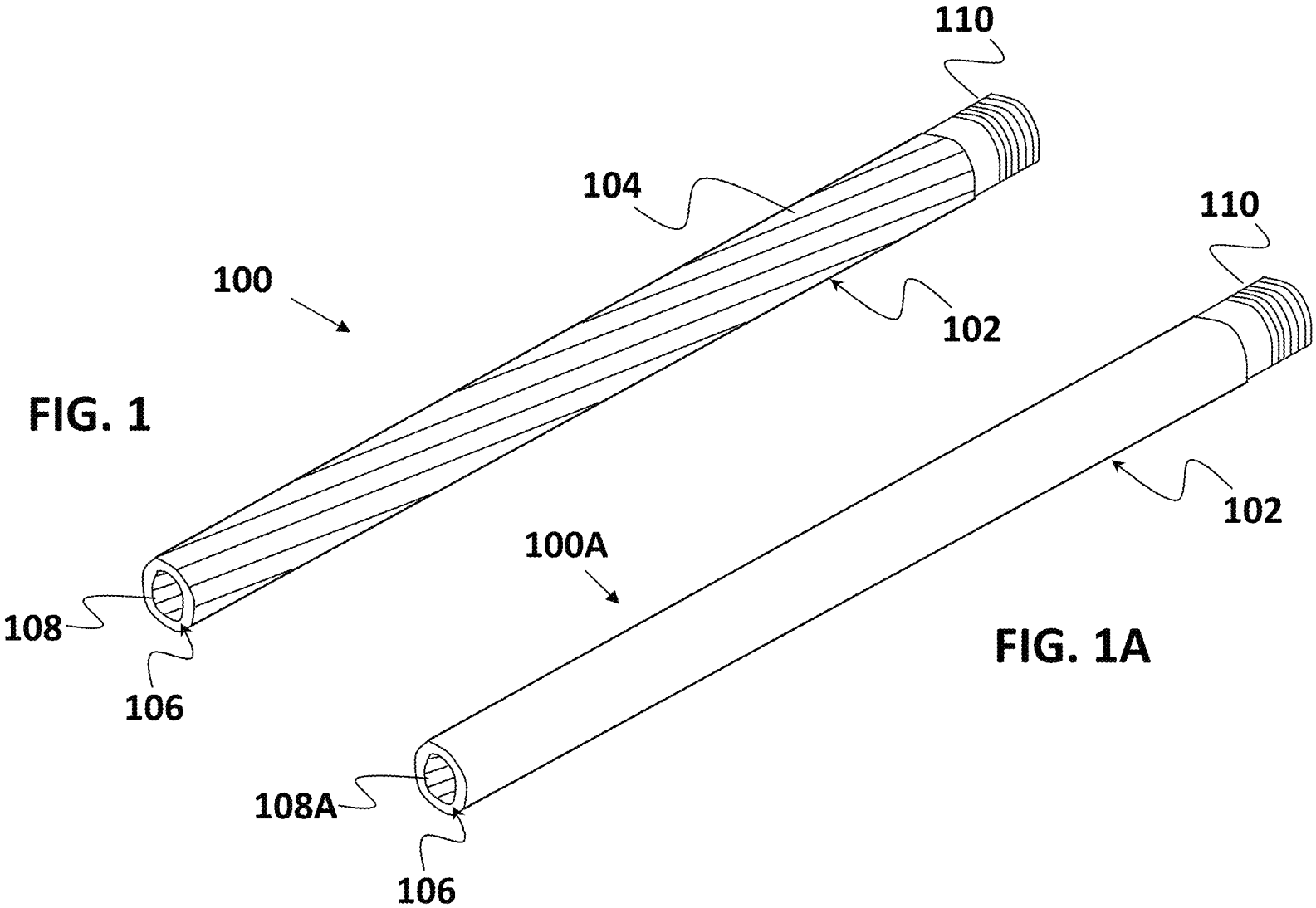
FIG. 1 is a somewhat schematic perspective view of a rifled barrel according to one embodiment incorporating principles of the present inventive concepts.
FIG. 1A is a somewhat schematic perspective view of a rifled barrel according to an alternative embodiment incorporating principles of the present inventive concepts.

Referring initially to FIG. 1, in one embodiment, a barrel 100 may be formed having rifling ridges 108 arranged along an interior surface (or diameter) 106 of the barrel by impressing corresponding features 104 into an external surface (or diameter) 102 of the barrel 100. Rifling is thereby provided by ridges 108 along an internal diameter 106 of the barrel 100 that correspond to the indentations 104 formed into the outside surface 102 of the barrel 100. This process is particularly suited for barrels formed from aluminum or other similar materials that may be readily extruded.

Referring additionally to FIGS. 2A, 2B, and 3 through 7, the barrel 100 may be formed, for instance, by pressing, pulling, or otherwise extruding a tubing 101 through a die 200 using a press (or drawing machine) 400. The die 200 may include, for instance, an opening 202 through which the tubing 101 is extruded. The opening 202 preferably comprises ridges 204 formed along a sidewall 203 of the opening 202 to impress corresponding indentations into an external diameter 102 of the tubing 101 being extruded or drawn through the die 200.

As indentations 104 are formed in the external diameter 102 of the tubing 101 using the die 200, corresponding ridges 108 are formed along the internal diameter 106 of the tubing 101. The die 200 and/or the tubing 101 may be rotated during the extrusion process to provide a twist rate to the indentations 104 and ridges 108 to provide a rifling pattern. The twist rate may be determined by the rate at which the die 200 or tube 101 is rotated in relation to the speed of the tube 101 being pressed or pulled through the die 200. A motor 402, such as a fixed or variable speed motor, could be used to rotate the die 200 and/or tubing 101 at a fixed or variable rate, as desired.

The die 200, in particular, may comprise an opening 202 configured to surround the tubing 101 during the extrusion or drawing process. The opening 202 may, for instance, have a substantially octagonal, decagonal, or other desired shape, with each side of the octagon, decagon, or other shape, having a bowed (or otherwise protruding) shape to form a ridge 204. Each side of the octagon, decagon, or other shape, may therefore provide one of the rifling ridges 108 to the barrel 100.

This process is therefore able to form polygonal rifling without the typically required hammer forging process. Some advantages of polygonal rifling include, for instance, a better gas seal around a projectile being fired through the barrel; less deformation of the projectile and less drag; a reduced buildup of lead fouling in a firearm barrel; and barrels that are less sensitive to stress concentrations because, unlike groove cutting, there are no sharp corners.

Of course, the invention is not limited to an octagonal or decagon-shaped die, and any other desired polygonal or other shape could be used (i.e., pentagon, hexagon, heptagon, octagon, nonagon, etc.). Furthermore, not all of the sides need to be bowed or otherwise protrude. For instance, one or more, but fewer than all, of the sides of the opening may be bowed or otherwise protruded to impress indentations into the tubing 101. The remaining sides may be flat or recessed so as not to provide indentations to the tubing 101. Further alternatively, a die 200 or other tool 300 (such as a bit, tab, or nub) (see FIG. 8) could be used to impress a single or multiple indentations into the external surface 102 of the tubing 101 without surrounding the external diameter 102 of the tubing 101.

Figures 2A, 2B, 2C:
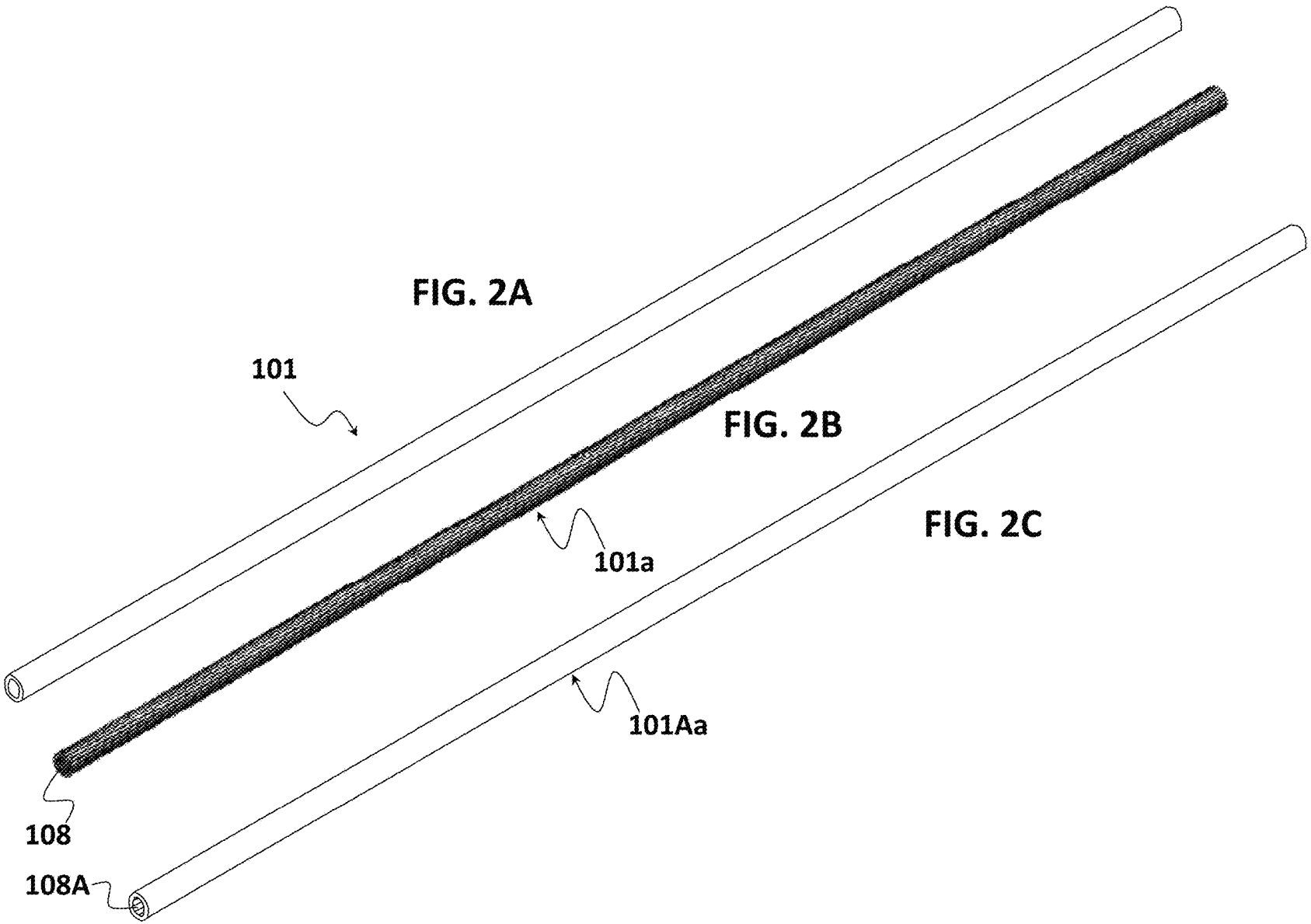
FIG. 2A is a somewhat schematic perspective view of a tube (or tubing) for forming the gun barrels of FIGS. 1 and 1A.
FIG. 2B is a somewhat schematic perspective view of a tube (or tubing) having rifling ridges formed along an internal diameter of the tube by impressing corresponding features into an outside diameter of the tube in a process of forming the barrel of FIG. 1, according to one embodiment incorporating principles of the present inventive concepts.
FIG. 2C is a somewhat schematic perspective view of a tube having rifling formed along an internal diameter of the tube using a drawing process in a process of forming the barrel of FIG. 1A, according to another embodiment incorporating principles of the present inventive concepts.
Figure 3:
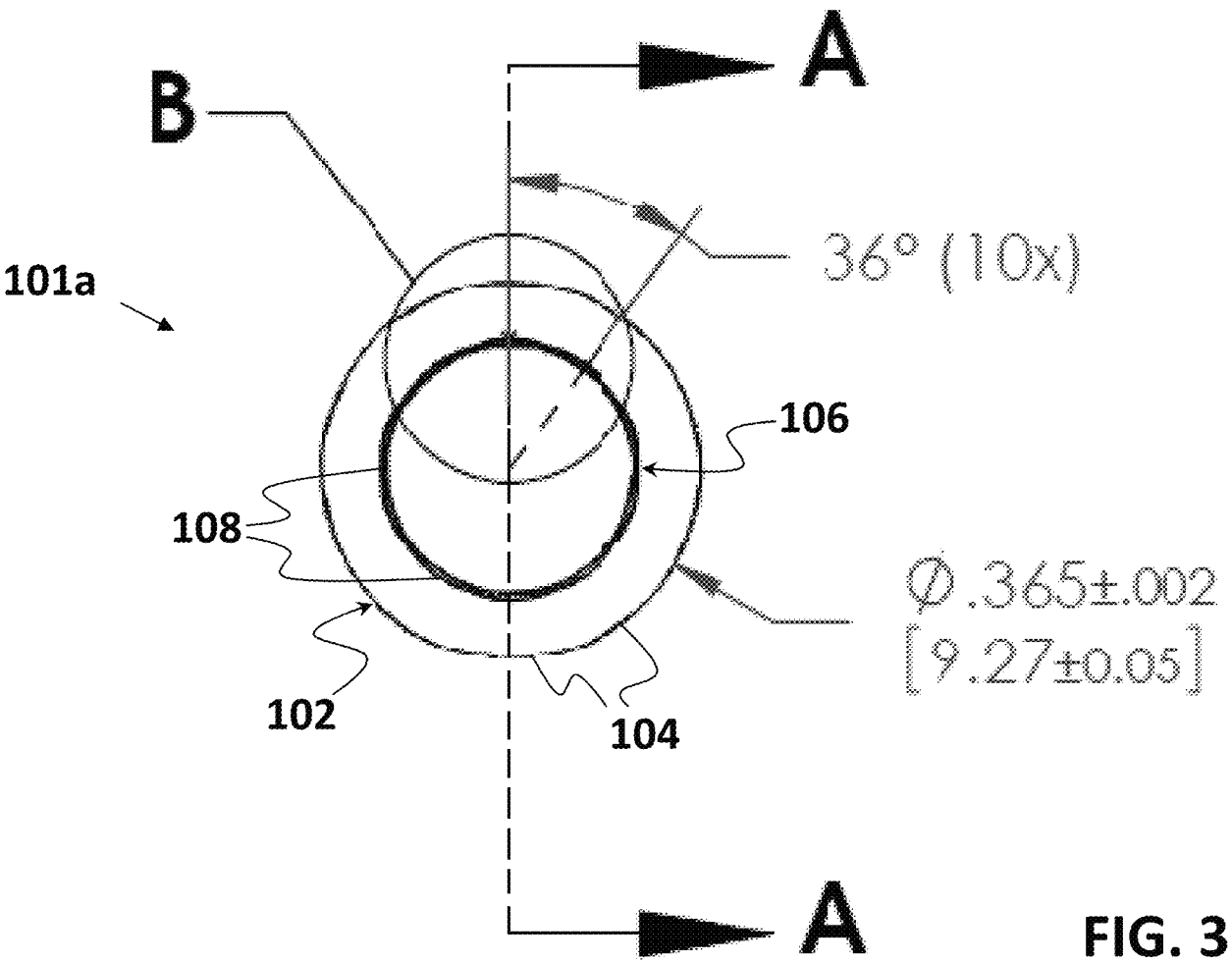
FIG. 3 is a somewhat schematic front plan view of the tube of FIG. 2B.
Figure 4:
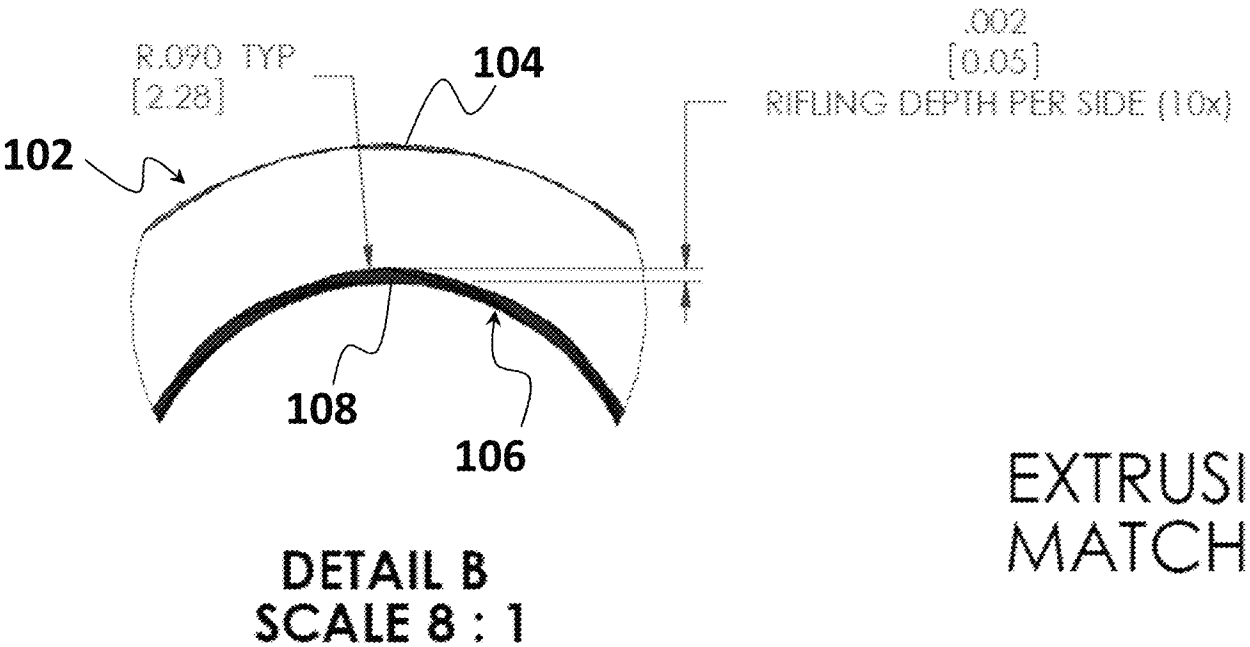
FIG. 4 is a somewhat schematic detail view of Section B of FIG. 3 illustrating a portion of the tube in more detail.
Figure 5:
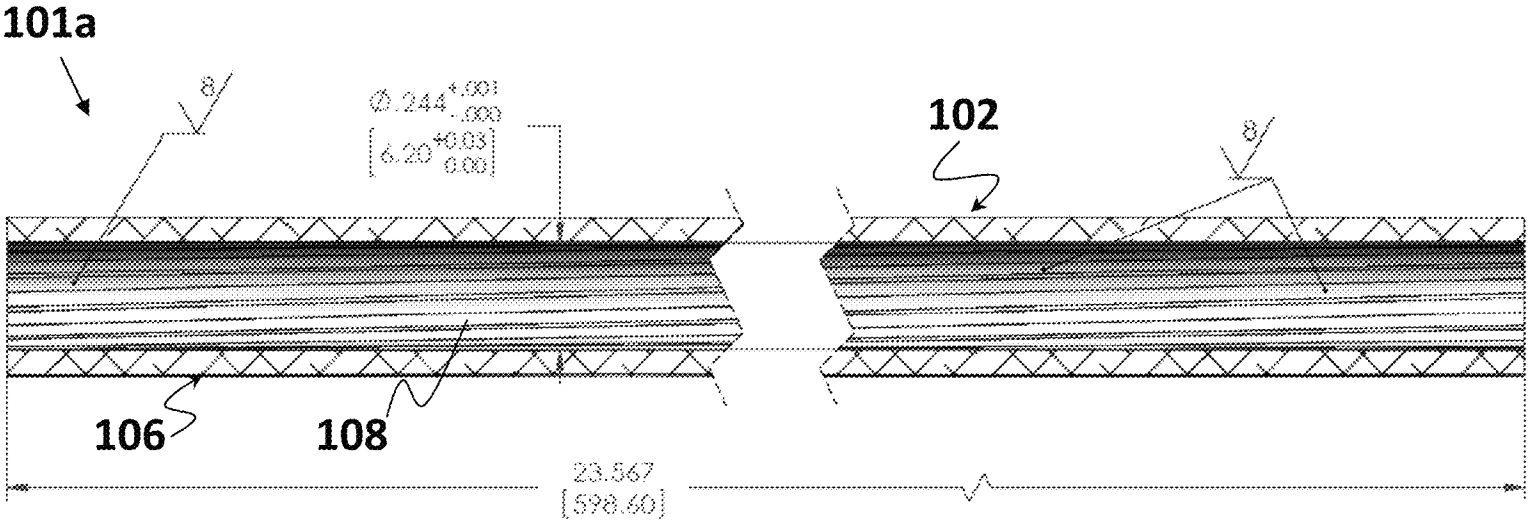
FIG. 5 is a somewhat schematic cross-sectional side view of the rifled tube of FIG. 2B, taken along section A-A of FIG. 3.
Figure 6:
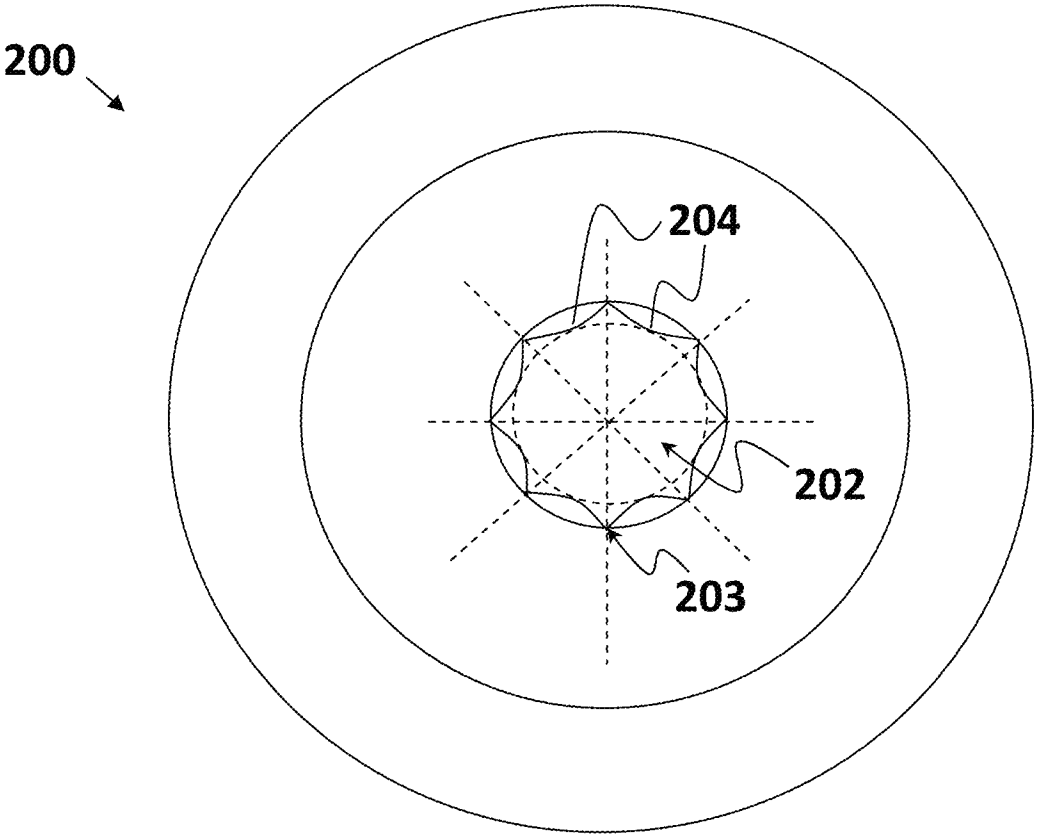
FIG. 6 is a somewhat schematic front plan view of a die configuration that can be used to form the rifled tube of FIG. 2B according to a still further aspect of the present inventive concepts.
Figure 7:
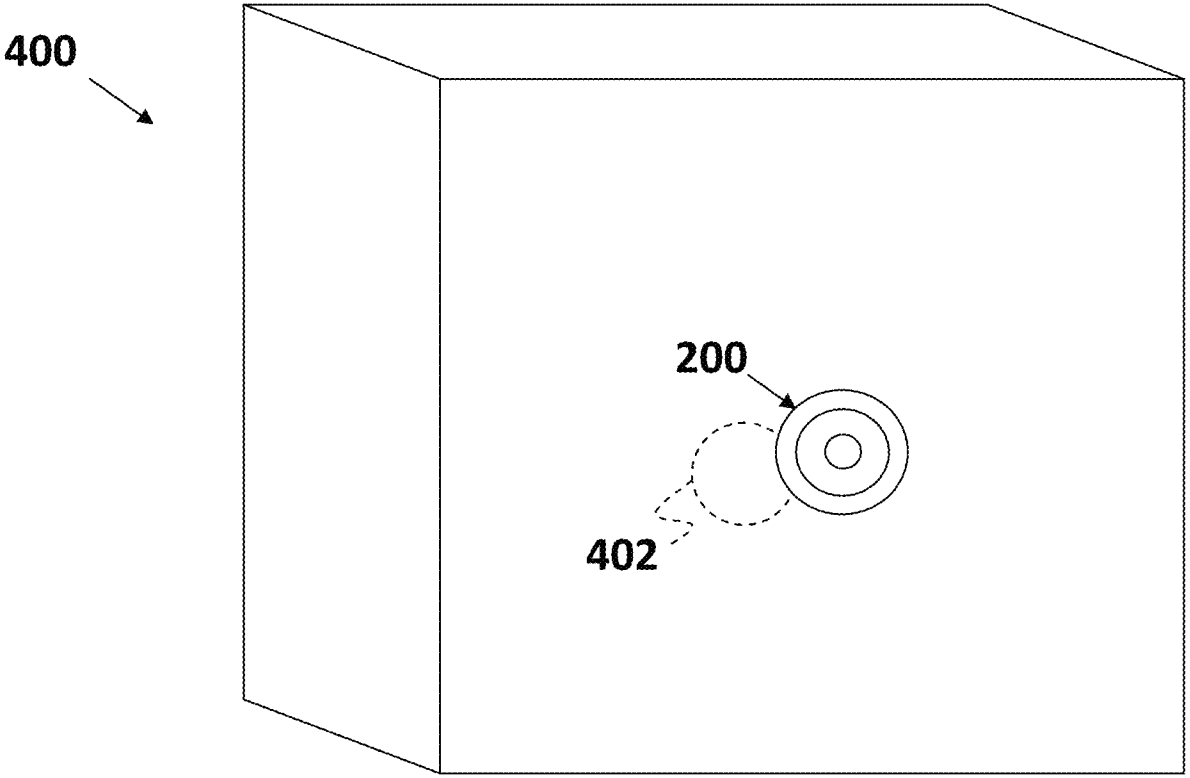
FIG. 7 is a schematic illustration of an extrusion press and die that can be used to form the rifled tube of FIG. 2B, according to additional principles of the present inventive concepts.
Figure 8A:
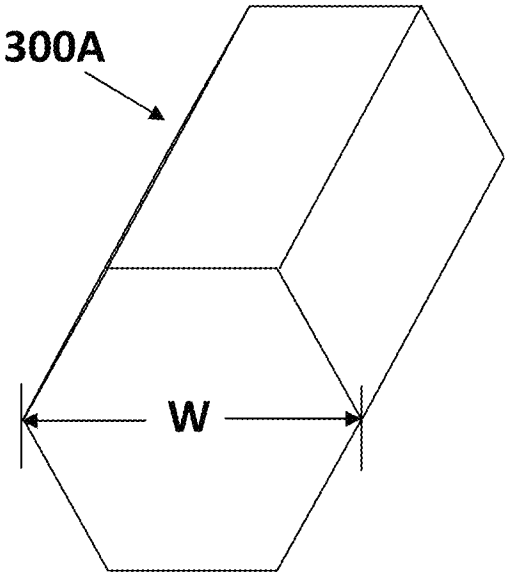
FIG. 8A is a somewhat schematic illustration of a tool for forming rifling on an internal diameter of a tubing during a drawing process, according to still further features of the present inventive concepts.
Figure 8:
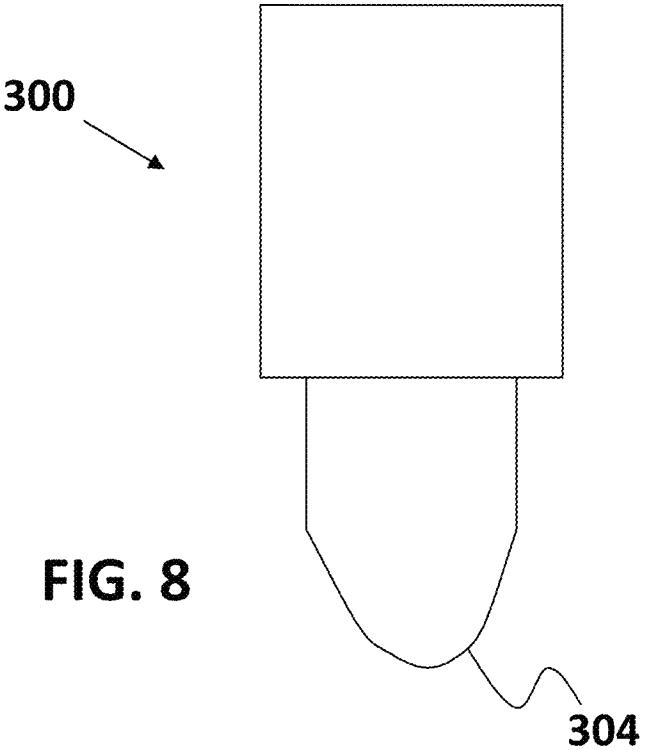
FIG. 8 is a somewhat schematic illustration of a nub or bit for forming one or more indentations into the tube to form the rifled tube of FIG. 2B according to alternative features of the present inventive concepts.

Referring additionally to FIGS. 1A, 2C, and 8A, the rifling pattern 108A could alternatively be formed in long lengths of tubing 101 through a drawing process that is entirely separate from, or accompanies, an extrusion process. In such a drawing process, rather than apply the die or tooling to the external surface 102 of the tubing 101, a die or tool 300A may be pulled through the internal diameter 106 of the tube 101 to provide the rifling 108A to the internal diameter 106.

In such an embodiment, the drawing tool 300A may have an octagonal, hexagonal, pentagonal, or other shape and may be rotated as it is drawn through the internal diameter 106 of the tubing 101 to form the rifling pattern 108A. Alternatively, the tubing 101 may instead (or additionally) be rotated during the drawing process. The rotation speed of the tubing 101 and/or tool 300A may be selected to provide the desired twist rate of the rifling pattern 108. The rifling pattern 108A of this embodiment may comprise indentations in the internal diameter 106 of the tubing 101A, rather than protrusions.

Although the drawing process may not be able to form a rifled barrel with as small an internal diameter as the extrusion process, it may still be used to form rifling in long sections of tubing 101Aa before the tubing 101Aa is cut and threaded to form individual barrels 100A, and may therefore still result in cost savings over traditional methods. Using either process, tubing lengths of 20 to 40 feet or longer could be formed having an internal rifling pattern 108, 108A.

Following the extrusion or drawing process, a desired length of the rifled extruded tubing 101*a* or drawn tubing 101Aa may be cut to form a barrel 100, 100A. The barrel 100, 100A may then be provided with a connection mechanism 110, such as threading, to enable it to be connected to a pneumatic or other gun (not shown).

Applying principles of the present inventive concepts, a rifling pattern 108 may be formed on an internal surface 106 of a barrel 100 from the exterior surface 102 of the tubing 101, thereby eliminating various problems and limitations of the conventional process (which applied rifling directly to the internal diameter on individual barrels). Accordingly, a process according to the present inventive concepts can be used, for instance, to form a rifled barrel 100 having calibers less than 0.700 inches, and, more specifically, to form rifled barrels as small as .177 inch caliber or less. Therefore, in addition to cost savings, barrels formed using this method can also have improved size dimensions and other benefits.

Alternatively, various principles of the present inventive concepts can be used to form long lengths of rifled tubing 101Aa using a drawing process before the tubing 101Aa is cut into individual barrel lengths. Although such a process may have size limitations that are more restrictive than the extrusion process, it can still result in cost savings over traditional methods applied to individual barrel lengths.

Having described and illustrated principles of the present invention in various preferred embodiments thereof, it should be apparent that the invention can be modified in arrangement and detail without departing from such principles. For instance, similar to the conventional processes, the tubing 101 could be cut into barrel lengths before forming the rifling patterns 108 from the outside diameter. The rifling patterns 108 could therefore be formed into the separate barrel lengths from the external surface after they are cut. This may be desirable in situations where custom rifling patterns 108 are desired. Furthermore, any desired process for forcing the tubing through the die, or for forcing a die or tool through the tubing, could be used to produce the rifled tubing. Still alternatively, various die or tooling configurations could be used to impress indentations into an external diameter of the tubing to form the rifling pattern 108 on the internal diameter 106 of the tubing 101*a*. The barrel 100 could also be configured for guns other than pneumatic guns, such as firearms. And many other variations are possible within the spirit and scope of these inventive principles.

What is claimed is:

1. A pneumatic gun barrel, comprising:

a rifling pattern comprising one or more ridges or indentations formed in a spiral pattern on an internal surface of the barrel along an entire length of the barrel from a breech end to a muzzle end thereof;

an attachment mechanism formed on the breech end of the barrel for removably connecting the barrel to a pneumatic gun; and a spiral pattern of indentations corresponding to the rifling pattern formed along an external surface of the barrel and extending from the muzzle end of the barrel up to but not including the attachment mechanism.

2. A pneumatic gun barrel according to claim 1, wherein the spiral pattern of indentations is formed on a length of tubing longer than the length of the barrel and wherein the length of tubing is cut into a barrel length section after the spiral pattern of indentations is formed.

3. A pneumatic gun barrel according to claim 2, wherein the attachment mechanism is formed on the breech end of the barrel after cutting the length of tubing.

4. A pneumatic gun barrel according to claim 1, wherein the attachment mechanism comprises threads formed on the breech end of the barrel after the rifling pattern has been formed therein.

5. A pneumatic gun barrel according to claim 1, wherein the gun barrel is aluminum.

6. A pneumatic gun barrel according to claim 1, wherein the rifling pattern is formed by impressing the spiral pattern of indentations into the external surface of the barrel during an extrusion process performed on a length of tubing that is longer than the length of the barrel.

7. A pneumatic gun barrel according to claim 6, wherein the pneumatic gun barrel is formed by cutting the length of tubing into a barrel length section after the rifling pattern is formed therein.

8. A pneumatic gun barrel according to claim 7, wherein the attachment mechanism is formed into an outside surface of the breech end of the barrel length section after the length of tubing is cut.

9. A pneumatic gun barrel according to claim 8, wherein the attachment mechanism comprises threading formed into the outside surface of the breech end of the barrel length section of tubing.

10. A pneumatic gun barrel according to claim 9, wherein the attachment mechanism is configured to mate with threading formed in a breech of the pneumatic gun to connect the barrel directly to the pneumatic gun.

11. A gun barrel configured to be removably attached to a gun, said gun barrel further configured to impart spin to a projectile being launched from the gun, said gun barrel comprising:

a tube-like body having an internal surface and an external surface extending along a length of the body from a breech end to a muzzle end;

a rifling pattern comprising ridges arranged on the internal surface of the body in a spiral pattern and extending along the entire length of the body from the breech end to the muzzle end;

a spiral pattern of indentations corresponding to the rifling pattern formed along an external surface of the barrel and extending from the muzzle end of the barrel up to but not including an attachment mechanism formed on the breech end of the barrel.

12. A gun barrel according to claim 11, wherein the attachment mechanism is formed into the breech end of the gun barrel to removably attach the barrel to the gun.

13. A gun barrel according to claim 11, wherein the-gun barrel is formed through an extrusion process performed by extruding a length of tubing that is longer than the length of the barrel through a die having a tool that impresses the spiral pattern of indentations into an external surface of the length of tubing as either the length of tubing or the die is rotated.

14. A barrel according to claim 11, wherein the pneumatic gun barrel is formed by cutting the length of tubing into a barrel length section after the rifling pattern is formed therein.

15. A method for forming a rifled barrel for a gun, said method comprising:

forming protrusions along an internal surface of a length of tubing that is longer than a length of the rifled barrel using a tool that impresses indentations into an external surface of the tubing during an extrusion process performed on the length of tubing;

rotating the tubing or the tool, or both, while forming the indentations and protrusions such that the protrusions formed along the internal surface provide a rifling pattern that extends through an entire length of the rifled barrel and is capable of imparting spin to a projectile being launched through the rifled barrel;

cutting the length of tubing into multiple sections that have a length that corresponds to the length of the rifled gun barrel, after forming the rifling pattern therein; and forming an attachment mechanism on a breech end of a barrel length tubing section.

16. A method according to claim 15, wherein the tool comprises a die having an opening with one or more protrusions formed thereon configured to impress indentations into an external surface of the tubing as the tubing is extruded through the opening in the die.

17. A method according to claim 15, wherein forming the attachment mechanism removes the indentations from the external surface of the rifled barrel in the area where the attachment mechanism is formed.

18. A method according to claim 17, wherein forming the attachment mechanism comprises forming threading into the external surface of the cut tubing at a breech end thereof.

19. A method according to claim 15, further comprising forming attachment mechanisms on breech ends of each the barrel length tubing sections.

20. A method according to claim 15, wherein the tool comprises a nub or bit for forming indentations in the external surface of the barrel.

* * * * *